United States Patent [19]

Murphy et al.

[11] 4,169,627

[45] Oct. 2, 1979

[54] FRAME RETENTION SYSTEM FOR SEAT COMPONENTS

[75] Inventors: Randall T. Murphy; Thomas H. Keane, both of Morristown, Tenn.

[73] Assignee: Lear Siegler, Inc., Troy, Mich.

[21] Appl. No.: 929,158

[22] Filed: Jul. 31, 1978

[51] Int. Cl.[2] ..... A47C 7/02

[52] U.S. Cl. ..... 297/452; 297/455

[58] Field of Search ..... 297/452, 454–456

[56] References Cited

U.S. PATENT DOCUMENTS

| | | | |
|---|---|---|---|
| 3,915,493 | 10/1975 | Brown | 297/452 X |
| 4,025,114 | 5/1977 | Cave | 297/455 X |
| 4,065,181 | 12/1977 | Gunlock et al. | 297/455 X |
| 4,065,182 | 12/1977 | Braniff et al. | 297/455 X |

*Primary Examiner*—James C. Mitchell

*Attorney, Agent, or Firm*—Reising, Ethington, Barnard, Perry & Brooks

[57] ABSTRACT

A retention system is disclosed for securing back and/or cushion seat components (14,16) to a seat frame (12) by a releasable retainer (20). Latches (18,22) are also used to secure both the seat back and cushion in the preferred embodiment. The back is secured to the frame by the latches and is engaged by the cushion such that securement of the cushion by the retainer maintains both the cushion and the back in place on the frame. Each latch includes a latch member (34,80) and a keeper surface that are engaged by relative movement between the associated seat component and the frame so as to provide the latched condition. The retainer includes a retainer member (44) having an intermediate bight section (46) secured to the frame and a pair of deflectable latch legs (48) extending in opposite directions from the bight section. A pair of keepers (50) on the seat cushion are engaged by the deflectable latch legs to secure the cushion to the frame. U-shaped ends (58) of the latch legs extend downwardly and provide handles for latching the legs.

20 Claims, 8 Drawing Figures

FRAME RETENTION SYSTEM FOR SEAT COMPONENTS

TECHNICAL FIELD

This invention relates to a retention system for securing seat components such as seat backs and/or cushions to associated frames, and is particularly concerned with such a system which is especially adapted for use with vehicle seats.

BACKGROUND ART

Most vehicle seats include separate back and cushions or providing seat components on which a seat occupant is supported. The back and cushion must be secured with respect to each other in the proper relationship to provide comfortable seating.

U.S. Pat. No. 1,187,580 discloses a vehicle seat wherein the seat cushion and back are connected with each other by a spring latch.

U.S. Pat. No. 2,789,621 discloses a vehicle seat whose seat cushion is secured to an associated vehicle floor by a spring latch that includes a latch bracket secured to the floor and a latch member secured to the seat cushion.

DISCLOSURE OF INVENTION

An object of the present invention is to provide an improved retention system including a releasable retainer for securing seat components such as a seat cushion and/or a seat back to a frame.

In carrying out the above object, a preferred embodiment of the retention system is utilized to secure both a seat back and a seat cushion to an associated seat frame in a releasable manner. Latches including latch members on the seat back and cooperable keeper surfaces on the frame have a latched condition where the latch members are engaged with the keeper surfaces by relative movement between the back and the frame. The seat cushion includes a releasable retainer that secures the cushion to the frame in an engaged condition with the back so that the latches of the back are thereby maintained in the latched condition that secures the back to the frame. An additional latch including a latch member on the cushion and a keeper surface on the frame cooperates with the retainer to secure the cushion to the frame.

The retainer of the system includes a unitary retainer member formed from wire with an intermediate bight section that is secured to the frame and a pair of deflectable latch legs that extend in opposite directions from the bight section. A pair of keepers on the seat cushion are respectively engaged by the latch legs upon deflection thereof so as to secure the seat cushion to the frame. Each latch leg of the retainer member has an end that is formed to extend away from a horizontal plane through the bight section, preferably with a U shape that opens upwardly toward the plane through the bight section. The bight section includes a pair of side torsion bars that are secured to the frame extending horizontally by a fastener and also includes a connecting bar that extends between the side torsion bars.

The keepers on the seat cushion preferably have slots that receive the latch legs inwardly from the U-shaped ends thereof in order to provide the retention of the seat cushion. Each keeper preferably has a U-shaped construction including a pair of side walls defining respective slots for receiving the associated latch leg and a connecting portion that connects the side walls. Upper ends of the side walls opposite the connecting portion of the keeper are secured to the seat frame. The keeper slots in the side walls each include a pair of edge surfaces that form a V shape and have a juncture including a rounded notch for receiving the associated latch leg.

Both the seat cushion and the seat back are received within the confines of a peripheral retention flange on a frame member of the seat frame such that the flange cooperates with the latches and the retainer to secure the seat cushion and back on the frame. An inwardly extending flange of the frame member secures a pan of the frame. Openings in the pan receive the latch members and the keeper surfaces of the latches are defined by the pan adjacent edges of the openings.

The relative positions of the latch members and the keeper surfaces of the latches on the seat components and the frame may be reversed while maintaining the operability of the latches. Likewise, the relative positions of the retainer member on the frame and the associated keepers on the seat cushion may also be reversed while maintaining the operability of the retainer. It is also possible to utilize the retainer with the seat back and to provide the seat cushion with a plurality of latches that are maintained in latched condition by engagement of the seat back with the seat cushion. Nevertheless, the construction which is disclosed is the preferred construction.

The objects, features, and advantages of the present invention are readily apparent from the following description of the best mode for carrying out the invention when taken in connection with the accompanying drawings.

BEST MODE FOR CARRYING OUT THE INVENTION

Figures 1, 2, 3, 8:
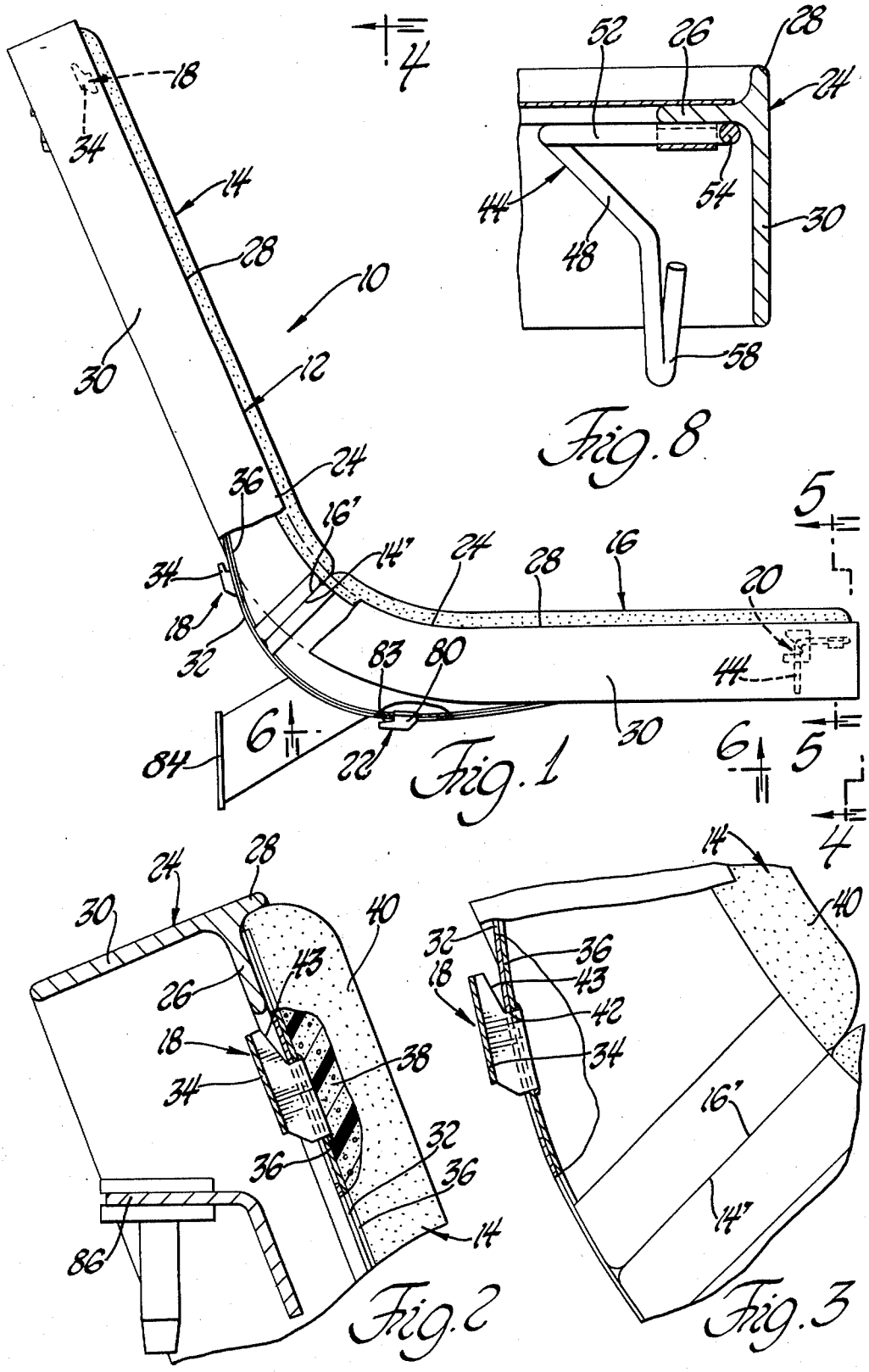
FIG. 1 is a partially broken away side elevation view of a seat that incorporates a retention system according to the present invention.
FIG. 2 is a sectional view of the seat taken along line 2—2 of FIG. 4 and illustrates a latch which is utilized to secure a seat back to a frame of the seat.
FIG. 3 is a view taken along line 3—3 of FIG. 4 and illustrates another latch utilized to secure the seat back to the frame.
FIG. 8 is a sectional view taken in a similar direction to FIG. 7 but showing the seat cushion removed with a retainer member of the retainer in an unlatched condition.

Referring to FIG. 1, a seat indicated collectively by 10 is particularly adapted for use as a vehicle seat on mass transit vehicles. Components of the seat 10 include a frame 12 as well as a seat back 14 and a seat cushion 16 which are secured to the frame by a retention system according to the present invention. A plurality of latches 18 cooperate to secure the seat back 14 to the frame in a manner which is more fully hereinafter described. A retainer 20 secures the seat cushion 16 to the frame 12 in cooperation with a latch 22. Securement of the seat cushion 16 to the frame 12 also engages the rear end 16' of the seat cushion with the lower end 14' of the seat back in order to maintain a latched condition of the latches 18.

The seat frame 12 includes a frame member 24 (FIG. 2) that extends about the seat back 14 and the seat cushion 16 and includes an inwardly extending flange 26 as well as a retention flange 28 and a trim flange 30. Frame 12 also includes a contoured sheet metal pan 32 that is secured to the inwardly extending flange 26 of the frame member 24 in any suitable manner such as by welding.

Figure 4:
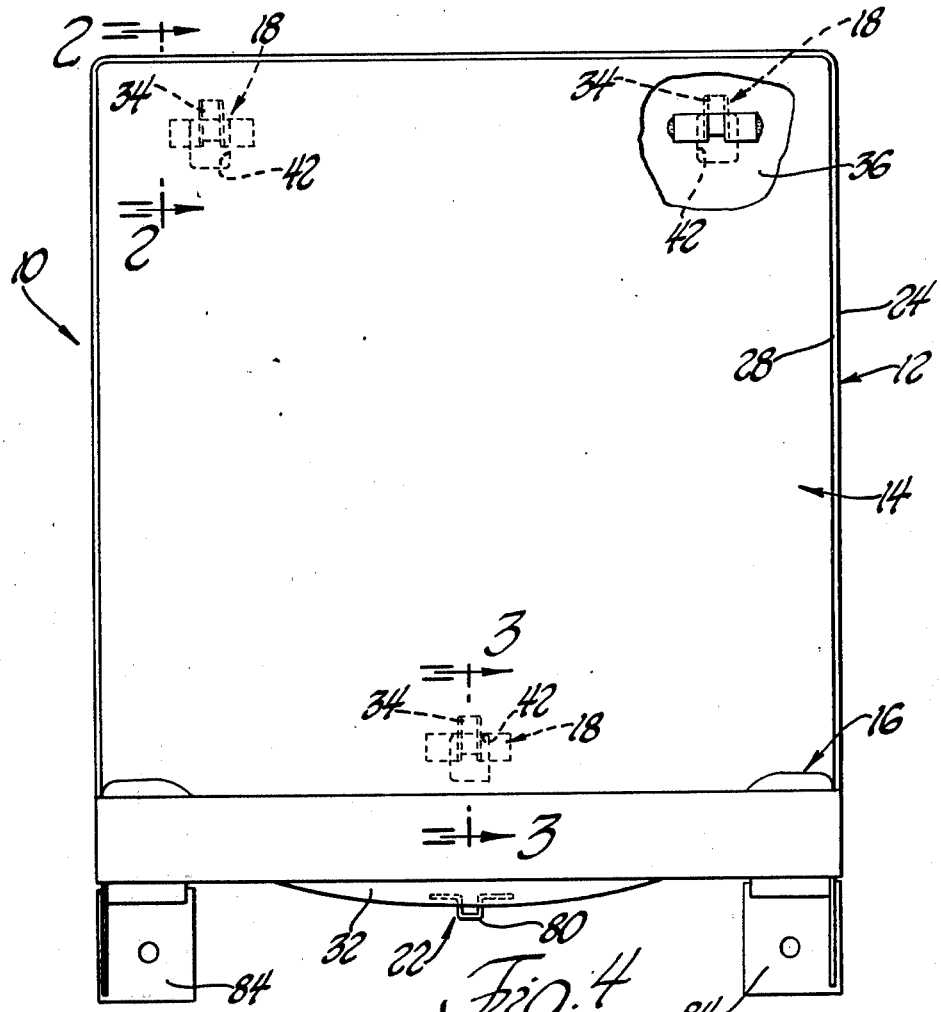
FIG. 4 is a front elevation view of the seat taken along line 4—4 of FIG. 1.

With reference to FIGS. 2, 3, and 4, each of the seat back latches 18 includes a hook shaped latch member 34 that is secured to a sheet metal pan 36 of the seat back 14. Foam 38 and a suitable trim covering 40 over the foam are also secured to the seat back pan 36 located on the opposite side thereof as the latch members 34. The frame pan 32 in the area occupied by the seat back 14 has openings 42 that receive the latch members 34 upon initial positioning of the seat back 14 on the frame before the seat cushion 16 is secured.

Each opening 42 has a dimension as viewed in FIGS. 2 and 3 which is greater than the corresponding distance of the associated latch member 34 between its angled lower end and its upper nose end. As such, the latch members 34 can be inserted through the pan openings 42 prior to upward movement of the seat back 14 in order to position the upper nose end of each latch member above the upper side of the adjacent pan opening. Above each of its openings 42, the rearward side of the pan provides a keeper surface that retains the associated latch member against movement. In this latched condition, the retention flange 28 of the frame member 24 cooperates with the latches 18 by engaging the periphery of the seat back 14 to prevent seat back movement. Wedging surfaces 43 of the latch members limit forward movement of the seat back 14 in the latched condition.

Figure 5:
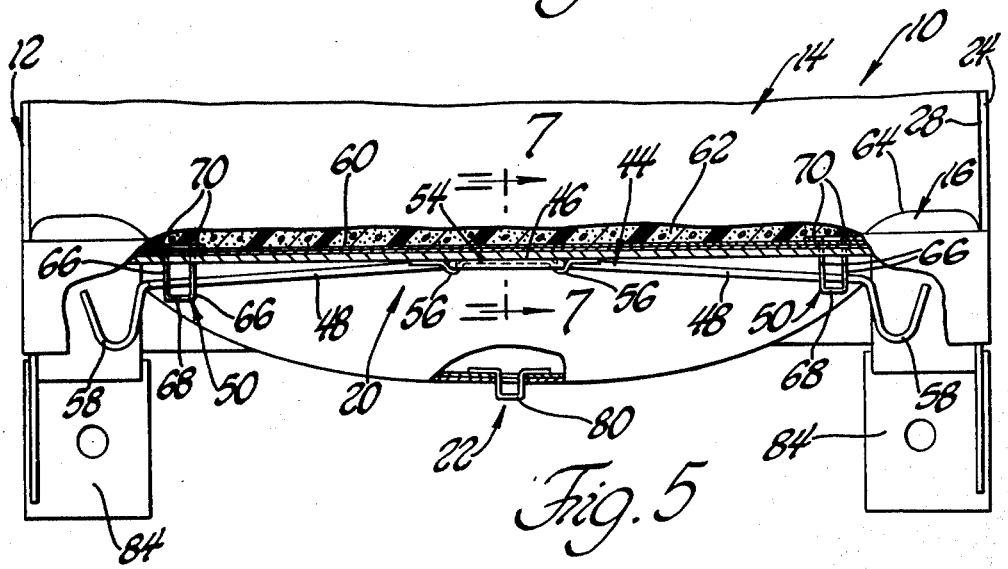
FIG. 5 is an elevation view of the seat taken in section along line 5—5 of FIG. 1 and illustrates a retainer that is utilized to secure a cushion of the seat to the frame.
Figure 6:
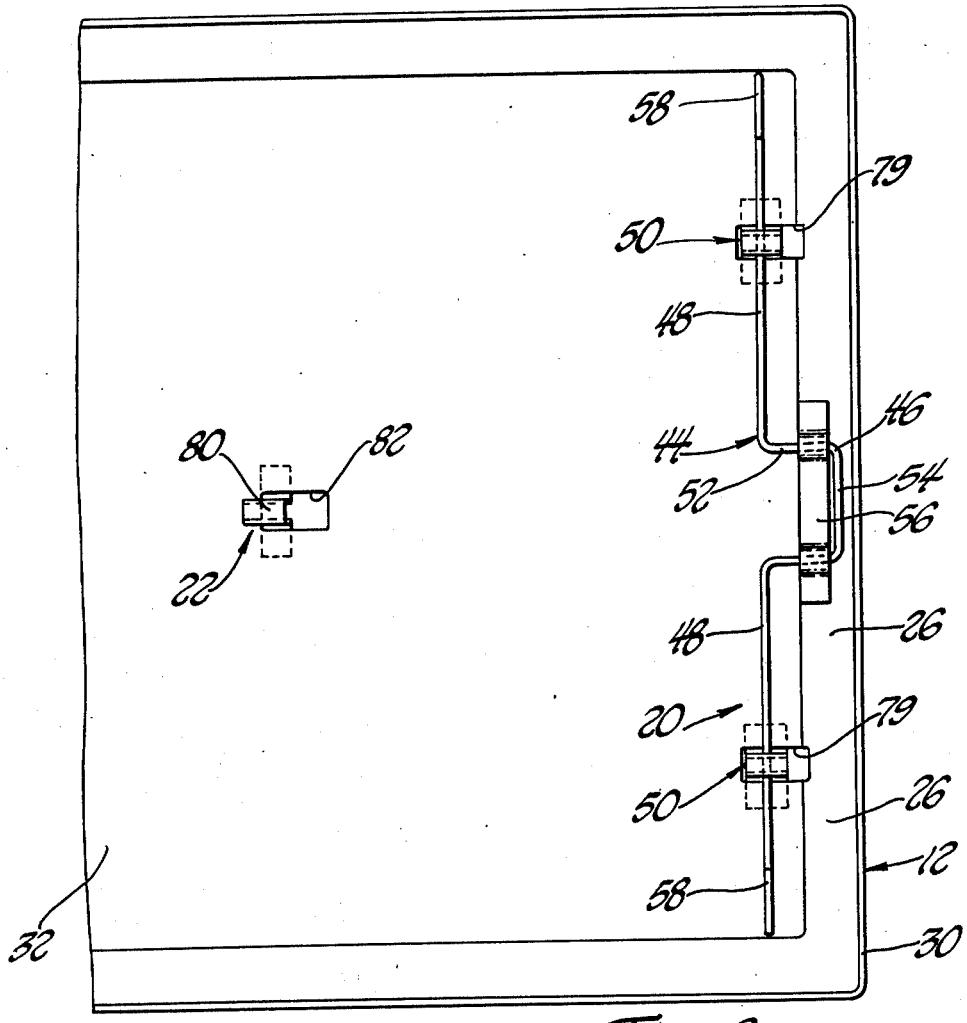
FIG. 6 is a bottom plan view of the front portion of the seat taken along line 6—6 of FIG. 1 and further illustrates the retainer and a latch which cooperates therewith to secure the seat cushion to the frame.
Figure 7:
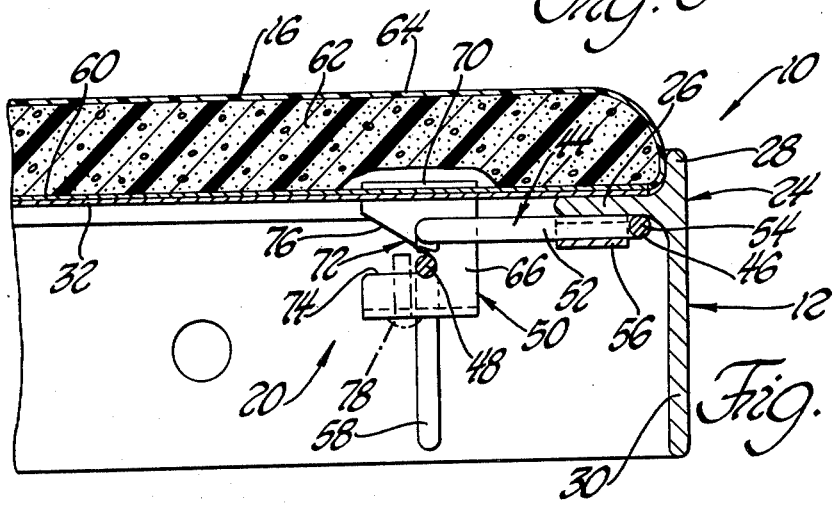
FIG. 7 is a sectional view taken along line 7—7 of FIG. 5 and further illustrates the retainer.

As seen in FIGS. 5, 6, and 7, the retainer 20 includes a unitary retainer member 44 formed from wire to include a bight section 46 and a pair of latch legs 48 that extend in opposite lateral directions from the bight section. A pair of keepers 50 on the seat cushion 16 receive the latch legs 48 to cooperate with the latch 22 (FIG. 6) in order to retain the seat cushion to the frame 12. As previously stated, the seat cushion 16 is secured to the frame after the seat back 14 is latched to the frame and the rear end 16' of the seat cushion engages the lower end 14' of the seat back in order to prevent downward movement of the seat back latches 18 from their latched condition shown.

Referring to FIGS. 5 and 6, bight section 46 of the retainer member 44 includes a pair of side torsion bars 52 and a connecting bar 54 that extends between the side torsion bars. All of the bars 52 and 54 extend generally horizontally and the side torsion bars are secured by a fastener 56 to the frame member flange 26. Latch legs 48 extend laterally from the opposite ends of the side torsion bars 52 as the connecting bar 54 and in their free condition shown in FIG. 8 extend downwardly and slightly forwardly with respect to the seat. U-shaped ends 58 of the latch legs 48 project downwardly away from the horizontal plane through the bight section 46 and open upwardly so as to provide a convenient handle for deflecting the latch legs to provide latching thereof to the keepers 50. Torsional deflection of the bight section torsion bars 52 and bending of the latch legs 48 takes place as the latch legs are moved from their free condition shown in FIG. 8 to the latched condition shown in FIGS. 5 through 7.

As seen in FIG. 7, the seat cushion 18 includes a sheet metal pan 60 on which foam 62 is supported and covered by a trim covering 64. Each keeper 50 has a U-shaped construction (FIG. 5) including a pair of side walls 66 whose lower ends are interconnected by a connection portion 68 and whose upper ends extend through an opening in the seat cushion pan 60 and have bent flanges 70 secured to the pan in any suitable manner such as by welding. Each keeper side wall 66 includes a V-shaped slot 72 (FIG. 7) defined by a lower horizontal edge surface 74 and an upper inclined edge surface 76. The associated latch leg 48 is received by the keeper within each slot 72 thereof and is located at the juncture of the edge surfaces 74 and 76 where the lower edge has a rounded notch for retaining the associated latch leg 48. A sheet metal screw 78 may be threaded through the connection portion 68 of each keeper 50 and extend upwardly behind the associated latch leg 48 in order to prevent its unlatching without the use of a tool. Each keeper 50 extends downwardly from the seat cushion pan 60 through an associated opening 79 (FIG. 6) in the frame pan 32 for latching with the retainer member 44 in the manner described.

As seen in FIGS. 4 through 6, the seat cushion latch 22 includes a latch member 80 secured to the seat cushion pan 60 so as to extend downwardly through an opening 82 in the frame pan 32. The seat cushion 16 is moved rearwardly and downwardly to initially insert the latch member 80 downwardly through the pan opening 82 so that the rear nose end of the latch member extends rearwardly of the rear edge surface of the opening. At the rear side of the opening 82, the pan provides a keeper surface that retains the latch member 80. A wedging surface 83 (FIG. 1) of the latch member 80 limits the upward movement of the rear end of the seat cushion. Latch 22 thus cooperates with the retainer 20 to secure the seat cushion 16 after the latch legs of the retainer are subsequently secured in the manner previously described.

Frame 12 of the seat includes lower securement flanges 84 shown in FIGS. 1 and 5 and upper securement flanges 86 shown in FIG. 2 for cooperating to secure the seat to a vehicle wall or other support with the seat cushion projecting outwardly in a cantilever manner.

While the best mode for carrying out this invention has herein been described in detail, those familiar with this art will recognize various alternative designs and embodiments for practicing the present invention as defined by the following claims.

What is claimed is:

1. In a seat including a frame component and a seat component supported by the frame component, a retention system comprising: a retainer including a member of a unitary construction made from wire and having an intermediate bight section secured to one of the components; the retainer member including a pair of deflectable latch legs extending in opposite directions from the bight section; and the other component including a pair of keepers that are respectively engaged by the latch legs upon deflection thereof so as to secure the seat component to the frame component.

2. In a seat including a frame and a seat component supported by the frame, a retention system comprising: a retainer including a member of a unitary construction made from wire and having an intermediate bight section secured to the frame; the retainer member including a pair of deflectable latch legs extending in opposite directions from the bight section; and the seat component including a pair of keepers that are respectively engaged by the latch legs upon deflection thereof so as to secure the seat component to the frame.

3. A seat as in claim 2 wherein the latch legs each include an end that is formed to extend away from a plane through the bight section.

4. A seat as in claim 3 wherein the ends of the latch legs have U shapes that open toward the plane that extends through the bight section.

5. A seat as in claims 2, 3, or 4 wherein the bight section includes a pair of side torsion bars that are deflected by engagement of the latch legs with the keeper, and the bight section also including a connecting bar that extends between the side torsion bars.

6. A seat as in claim 5 further including a fastener that secures the side torsion bars of the bight section to the frame.

7. A seat as in claim 5 further including a latch that includes a latch member on the seat component and a keeper surface on the frame for engaging the latch member such that the latch cooperates with the retainer to secure the seat component to the frame.

8. A seat as in claims 2, 3 or 4 wherein the keepers have slots that receive the latch legs.

9. A seat as in claim 8 wherein each keeper includes a pair of side walls that each define a slot for receiving the associated latch leg, each keeper also including a connecting portion that connects the side walls thereof to define a generally U shape, and each side wall of the keeper having an end secured to the seat component.

10. A seat as in claim 9 wherein each keeper slot includes a pair of surfaces that form a V shape and have a juncture including a rounded notch for receiving the associated latch leg.

11. A seat as in claim 8 further including a latch that includes a latch member on the seat component and a keeper surface on the frame for engaging the latch member such that the latch cooperates with the retainer to secure the seat component to the frame.

12. In a seat including a frame and a seat cushion supported by the frame, a retention system comprising: a retainer including a member of a unitary construction made from wire and having an intermediate bight section secured to the frame in a horizontally extending orientation; the retainer member including a pair of deflectable latch legs extending in opposite lateral directions from the bight section; and the seat cushion including a pair of keepers that are respectively engaged by the latch legs so as to secure the seat cushion to the frame.

13. In a seat including a frame and a seat cushion supported by the frame, a retention system comprising: a retainer including a member of a unitary construction made from wire and having an intermediate bight section including a pair of side torsion bars secured to the frame and a connecting bar that extends between the side torsion bars; a pair of latch legs extending in opposite lateral directions from the side torsion bars of the bight section; each latch leg having a U-shaped end whose closed side projects away from a plane through the bight section; the seat cushion including a pair of downwardly extending keepers; and each keeper including a slot that receives one of the latch legs upon deflection thereof so as to secure the seat cushion to the frame.

14. In a seat including a frame and a seat cushion supported by the frame, a retention system comprising: a retainer including a member of a unitary construction made from wire and having an intermediate bight section including a pair of side torsion bars secured to the frame and a connecting bar that extends between the side torsion bars; said bight section being located in a generally horizontally extending orientation; the retainer member also including a pair of deflectable latch legs extending in opposite lateral directions from the side torsion bars of the bight section; each latch leg having an end which is formed so as to extend away from a plane through the bight section; the seat cushion including a pair of downwardly extending keepers that are respectively engaged by the latch legs inwardly from the ends thereof upon deflection of the legs so as to secure the seat cushion to the frame member; and a latch that includes a latch member on the seat cushion and a keeper surface on the frame for engaging the latch member such that the latch cooperates with the retainer to secure the seat cushion to the frame.

15. In a seat including a frame component and a pair of seating components supported by the frame component, a retention system comprising: a plurality of latches for securing one of the seating components to the frame component; each of said latches including a latch member on one of the associated components thereof and a keeper surface on the other associated component thereof such that relative movement between said one seating component and the frame component engages the latch members with the keeper surfaces in a latched condition to provide securement therebetween; and a retainer for releasably securing the other seating component to the frame component while concomitantly engaging the other seating component with the one seating component to maintain the latches in the latched condition.

16. In a seat including a frame component and a pair of seating components supported by the frame component, a retention system comprising: a plurality of latches for securing one of the seating components to the frame component; each of said latches including a latch member on one of the associated components thereof and a keeper surface on the other associated component thereof such that relative movement between said one seating component and the frame component engages the latch members with the keeper surfaces to provide securement therebetween; a retainer for releasably securing the other seating component to the frame component while concomitantly engaging the other seating component with the one seating component to maintain the latches in the latched condition; the retainer including a member of a unitary construction made from wire and having an intermediate bight section secured to one of the associated components thereof; the retainer member including a pair of deflectable latch legs extending in opposite directions from the bight section; and the other associated component of the retainer including a pair of keepers that are respectively engaged by the latch legs upon deflection thereof so as to secure the other seating component to the frame component.

17. In a seat including a frame component and back and cushion components supported by the frame component, a retention system comprising: a plurality of latches for securing the back component to the frame component; each of said latches including a latch member on one of the associated components thereof and a keeper surface on the other associated component thereof such that relative movement between the back component and the frame component engages the latch members with the keeper surfaces to provide securement therebetween; and a retainer for releasably securing the cushion component to the frame component while concomitantly engaging the cushion component with the back component to maintain the latches in the latched condition.

18. In a seat including a frame and also including a back and a cushion supported by the frame, a retention system comprising: a plurality of latches for securing the back to the frame; each of said latches including a latch member on the back and a keeper surface on the frame such that relative movement between the back and the frame engages the latch members with the keeper surfaces to provide securement therebetween; a retainer for releasably securing the cushion to the frame while concomitantly engaging the cushion with the back to maintain the latches in the latched condition; the retainer including a member of a unitary construction made from wire and having an intermediate bight section including a pair of side torsion bars secured to the frame and a connecting bar that extends between the side torsion bars; said bight section being located in a generally horizontally extending orientation; the retainer member also including a pair of deflectable latch legs extending in opposite lateral directions from the side torsion bars of the bight section; each latch leg having an end which is formed so as to extend away from a plane through the bight section; the seat cushion including a pair of downwardly extending keepers that are respectively engaged by the latch legs inwardly from the ends thereof upon deflection of the legs so as to secure the seat cushion to the frame; and an additional latch that includes a latch member on the seat cushion and a keeper surface on the frame for engaging the latch member thereof such that the additional latch cooperates with the retainer to secure the seat cushion to the frame.

19. A seat as in claim 18 wherein the frame includes a frame member including flanges that engage the seat back and the seat cushion to cooperate with the latches and retainer in securing the seat back and the seat cushion to the frame.

20. A seat as in claim 19 wherein the frame further includes a pan that is secured to the frame member thereof, and said pan including openings that receive the latch members, and the pan defining the keeper surfaces for the latch members adjacent the openings thereof.

* * * * *